US009573033B2

(12) United States Patent
Surbrook

(10) Patent No.: US 9,573,033 B2
(45) Date of Patent: Feb. 21, 2017

(54) RETURNING GOAL SYSTEM

(71) Applicant: Scott T. Surbrook, Bartlett, TN (US)

(72) Inventor: Scott T. Surbrook, Bartlett, TN (US)

( * ) Notice: Subject to any disclaimer, the term of this patent is extended or adjusted under 35 U.S.C. 154(b) by 240 days.

(21) Appl. No.: 14/053,882

(22) Filed: Oct. 15, 2013

(65) Prior Publication Data

US 2014/0106906 A1 Apr. 17, 2014

Related U.S. Application Data

(60) Provisional application No. 61/713,944, filed on Oct. 15, 2012.

(51) Int. Cl.
*A63B 69/00* (2006.01)
*A63B 63/00* (2006.01)
*A63B 71/02* (2006.01)

(52) U.S. Cl.
CPC ..... *A63B 63/004* (2013.01); *A63B 69/002* (2013.01); *A63B 69/0097* (2013.01); *A63B 2063/001* (2013.01); *A63B 2063/005* (2013.01); *A63B 2071/025* (2013.01)

(58) Field of Classification Search
CPC ..... A63B 63/004; A63B 2063/001; A63B 63/001; A63B 71/022
USPC ..... 273/394–397; 473/478, 431, 434, 435
See application file for complete search history.

(56) References Cited

U.S. PATENT DOCUMENTS 331,756 A * 12/1885 Baker ..... A63B 63/004 273/126 A
1,540,670 A 6/1925 Vidmer
2,077,343 A * 4/1937 Oakes ..... A63B 63/004 473/478
2,899,208 A 8/1959 Wallsteiner
4,068,846 A 1/1978 Forrest
4,083,561 A 4/1978 Daffer, Jr.
4,286,786 A 9/1981 Papadopoulos
4,615,528 A * 10/1986 York ..... A63B 63/00 273/127 C
4,921,257 A 5/1990 Heller
(Continued)

FOREIGN PATENT DOCUMENTS

GB 2070441 A 9/1981
GB 2463926 A 4/2010
(Continued)

OTHER PUBLICATIONS

Primed 7' ×5' Soccer Trainer; Dick's Sporting Goods; http://www.dickssportinggoods.com/product/index.jsp? productId=20; It is not known whether or not this reference is prior art or not. However, it is requested to be considered as prior art for the purposes of examination only.

(Continued)

*Primary Examiner* — Mark Graham
(74) *Attorney, Agent, or Firm* — Luedeka Neely Group, P.C.

(57) ABSTRACT

A returning goal system including a generally U-shaped entryway, first and second sides extending away from the entryway, and lower and upper back crossbars extending between the sides to form lower and upper open portions. A net is connected to the goal and covers the lower open portion and upper open portion. The lower open portion of the net is sufficiently tensioned so as to return a ball towards the entryway without causing it to be ejected from the goal.

16 Claims, 21 Drawing Sheets

(56) References Cited

U.S. PATENT DOCUMENTS

| | | | | |
|---|---|---|---|---|
| 5,308,083 | A | 5/1994 | Grunfeld et al. | |
| 5,433,433 | A | 7/1995 | Armell | |
| 5,549,304 | A | 8/1996 | Davis | |
| 5,556,104 | A | 9/1996 | Guillen, Jr. | |
| 5,586,768 | A | 12/1996 | Pavonetti | |
| 5,615,889 | A | 4/1997 | Long | |
| 5,830,089 | A | 11/1998 | Halter et al. | |
| 6,165,085 | A | 12/2000 | Lubin | |
| 6,209,878 | B1 | 4/2001 | Munro | |
| 6,352,480 | B1 | 3/2002 | Macaluso | |
| 6,379,272 | B1 * | 4/2002 | Gorgo | A63B 71/022 273/407 |
| 6,659,892 | B2 | 12/2003 | Lytle et al. | |
| 6,935,971 | B2 | 8/2005 | Piras et al. | |
| 7,021,630 | B1 | 4/2006 | Cho | |
| 7,244,199 | B1 | 7/2007 | Romano | |
| 7,264,245 | B2 | 9/2007 | Cho | |
| 7,543,821 | B2 | 6/2009 | Winningham et al. | |
| 7,614,968 | B1 | 11/2009 | Davies | |
| 7,731,198 | B2 | 6/2010 | Cho | |
| 7,914,402 | B2 | 3/2011 | Gaudin et al. | |
| 8,246,494 | B2 | 8/2012 | Stephenson | |
| 2003/0224866 | A1 * | 12/2003 | Chen | A63B 61/003 473/197 |
| 2004/0178585 | A1 | 9/2004 | Cosenza | |
| 2005/0137035 | A1 * | 6/2005 | Huang | A63B 69/0002 473/454 |
| 2007/0235942 | A1 * | 10/2007 | Cho | A63B 63/004 273/395 |
| 2008/0096695 | A1 * | 4/2008 | Winningham | A63B 63/004 473/435 |
| 2009/0181810 | A1 | 7/2009 | Stephenson | |
| 2010/0317467 | A1 | 12/2010 | Freynhofer et al. | |
| 2011/0015002 | A1 | 1/2011 | Brown | |
| 2012/0157239 | A1 * | 6/2012 | Elpers | A63B 63/00 473/416 |
| 2012/0208658 | A1 * | 8/2012 | Christgau | A63B 69/0097 473/435 |
| 2012/0214620 | A1 | 8/2012 | Conforti et al. | |
| 2012/0252606 | A1 * | 10/2012 | Ennis | A63B 63/004 473/478 |

FOREIGN PATENT DOCUMENTS

| | | | |
|---|---|---|---|
| WO | 2006044389 | A | 4/2006 |
| WO | 2008145947 | A1 | 12/2008 |

OTHER PUBLICATIONS

Franklin Crossfire Pop-Up Trainer; Dick's Sporting Goods; http://www.dickssportinggoods.com/product/index.jsp?productId=20; It is not known whether or not this reference is prior art or not. However, it is requested to be considered as prior art for the purposes of examination only.

* cited by examiner

RETURNING GOAL SYSTEM

FIELD

The present disclosure relates to the field of sporting equipment. Specifically, the present disclosure relates to a goal system for trapping a ball and returning the ball to the front of the goal.

INTRODUCTION

Training soccer goals generally allow an individual player to kick a soccer ball into the goal and then forcefully eject the ball out of the soccer goal and back to the player. These goals allow individual players to practice multiple kicks without having to fetch the soccer ball after each practice kick. Training soccer goals are generally not suitable for use with a goalie attempting to block shots in the goal as the mechanism for returning the soccer ball occupies the interior space of the goal. Additionally, training soccer goals may forcefully return the soccer ball back out of the goal, possibly striking the goalie. Further, soccer balls returned from the training soccer goals may comprise a tripping hazard to other players on the field.

Soccer goals used during games and in practices where a goalie is present allow a goalie to stand in an opening of the goal to attempt to block shots at the goal. When a soccer ball enters the soccer goal, the soccer ball is trapped in the back of the net, requiring the goalie or other players to retrieve the ball from the back of the net. Also, balls frequently escape the bottom of the traditional goal. Requiring a goalie or player to fetch the soccer ball from the back of the net or balls that escape from the bottom of the goal cost valuable practice or game time, particularly in practices where several shots may be taken in a relatively short amount of time.

What is needed, therefore, is a soccer goal capable of absorbing the impact of a soccer ball kicked into the goal and that is capable of returning the soccer ball to the front of the goal without forcefully ejecting the soccer ball from the goal. What is further needed is a soccer goal capable of returning a soccer ball that can be used when a goalie is present in the goal.

SUMMARY OF THE CLAIMS

The above and other needs are met by a returning goal system including a generally U-shaped entryway, first and second sides extending away from the entryway, and lower and upper back crossbars extending between the sides to form lower and upper open portions. A net is connected to the goal and covers the first and second sides, lower open portion and upper open portion. The lower open portion of the net is sufficiently tensioned so as to gently return a ball toward the entryway without causing it to be ejected from the goal.

The entryway is defined by an elongate crossbar, a first vertical support post and a second vertical support post. The front crossbar has a first end and a second end. The first support post has a top and a bottom. The top of the first support post is attached to the first end of the front crossbar. The second support post also has a top and a bottom. In a similar fashion to the first vertical post, the top of the second support post is attached to the second end of the front crossbar.

The first side extends away from the entryway proximate the first end of the front crossbar. The first side is defined by the first support post, a first lower support bar, a first lower net support, and a first upper net support. The first lower support bar is connected at a first end to the bottom of the first support post and is connected at a second end to a bottom of the first lower net support. The top of the first lower net support is connected to a bottom of the first upper net support. A top of the first upper net support is connected adjacent to the top of the first support post.

The second side extends away from the entryway proximate the second end of the front crossbar. The second side is defined by the second support post, a second lower support bar, a second lower net support, and a second upper net support. The second lower support bar is connected at a first end to the bottom of the second support post and is connected at a second end to a bottom of the second lower net support. The top of the second lower net support is connected to a bottom of the second upper net support. A top of the second upper net support is connected adjacent to the top of the second support post.

The lower back crossbar is positioned between the first and second sides adjacent the bottom of the first and second lower net supports. An upper back crossbar is positioned between the first and second sides adjacent the top of the first and second lower net supports. A lower open portion is located between the first and second sides and is defined by the upper and lower back crossbars, and the first and second lower net supports. Similarly, an upper open portion is located between the first and second sides and is defined by the front crossbar, the upper back crossbar and the first and second upper net supports. Finally, a net is connected to the goal and cover the lower open portion and upper open portion. The lower open portion covered by the net is sufficiently tensioned so as to gently return a ball toward the entryway without causing it to be ejected from the goal.

In certain embodiments, the goal system includes a rope-type net tensioning mechanism that includes a tensioning rope for connecting an end of the net to the upper back crossbar. The tensioning ropes permits selectively tensioning and un-tensioning at least a first portion of the net covering the lower open portion of the goal. In other embodiments, the goal system includes a lever-type net tensioning mechanism for selectively tensioning and un-tensioning at least a first portion of the net covering the lower open portion of the goal. The lever tensioning mechanism includes a U-shaped lever arm operable for connecting to an end of the net that is rotatably mounted to outer faces of the upper net support for moving the net from a tensioned to an un-tensioned position. The mechanism is attached to the goal using a plurality of pin-type connection members that permit securing the lever arm in a tensioned or an un-tensioned position.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

This application claims the benefit of U.S. Provisional Application No. 61/713,944, filed Oct. 15, 2012.

Figure 1:
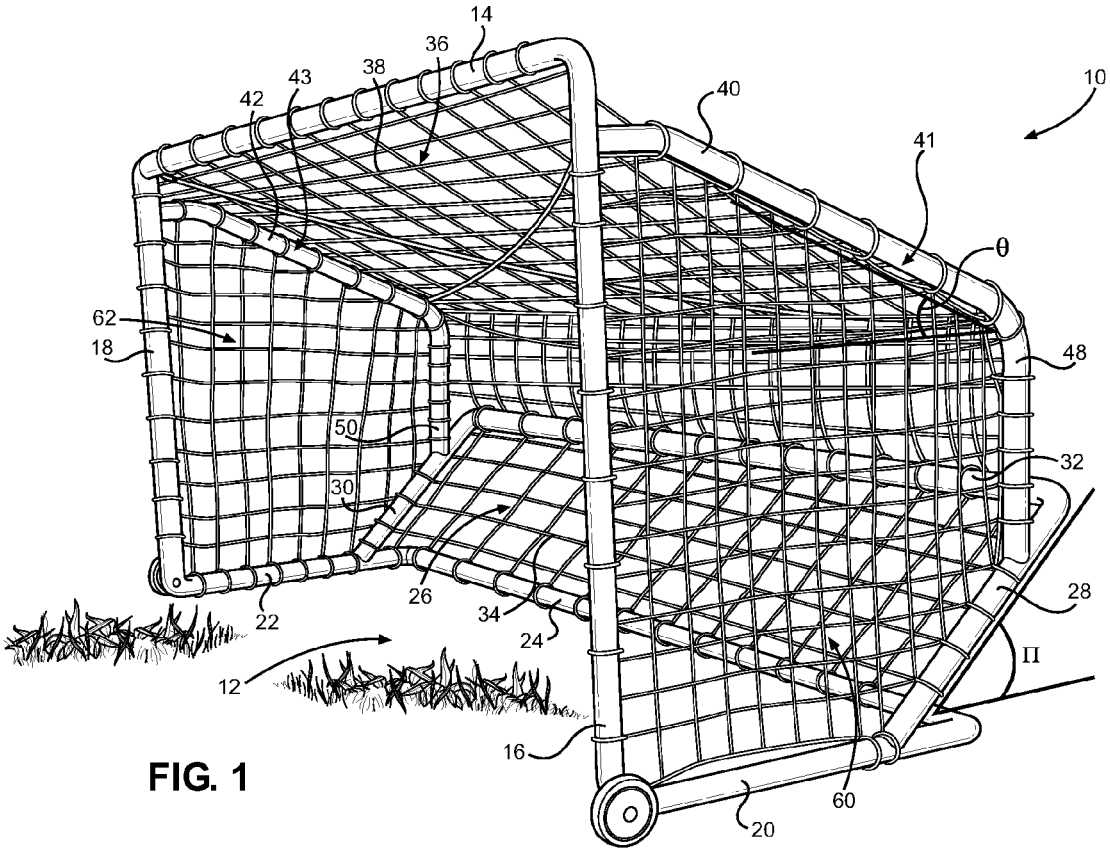
FIG. 1 is a front three-quarter perspective view of a returning goal system in accordance with embodiments of the present invention.
Figure 2:
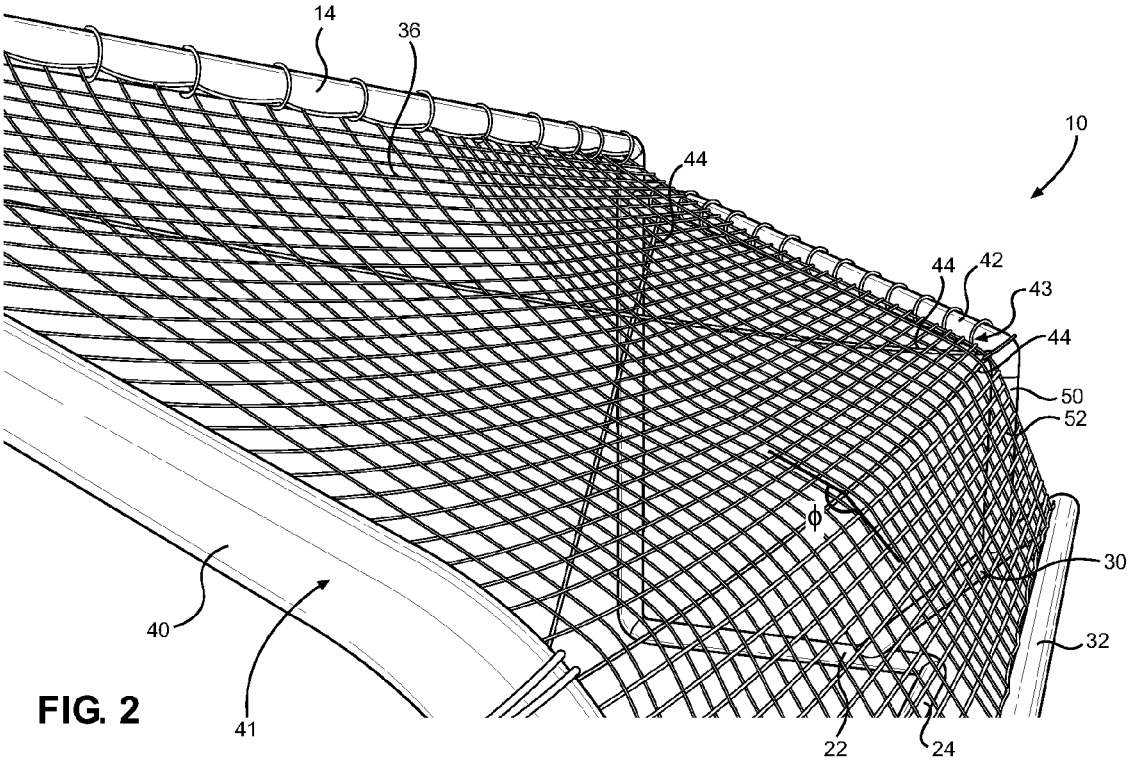
FIG. 2 is a rear three-quarter perspective view of the returning goal system depicted in FIG. 1.
Figure 3:
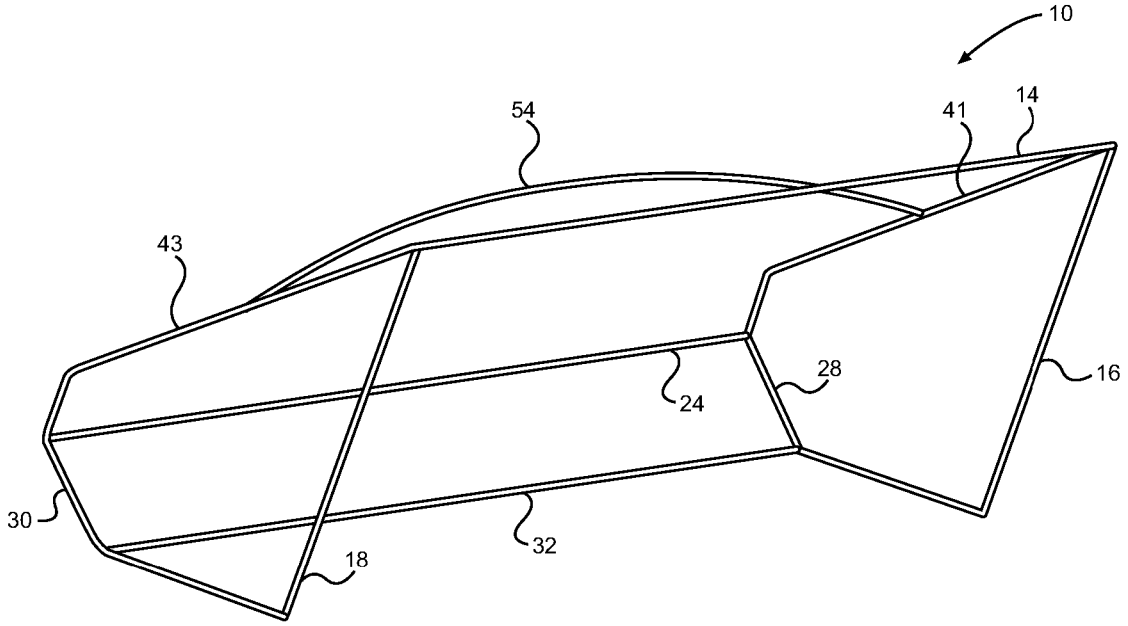
FIG. 3 is a front three-quarter perspective view of a returning goal system having an arched net support in accordance with embodiments of the present invention.

Turning now to the figures and, in particular, to FIGS. 1 and 2, there is provided a returning soccer goal 10. This goal 10 is configured to absorb the impact of a soccer ball traveling into the goal and to then gently return the soccer ball toward the front of the goal. Preferably, the ball is returned without returning the ball back onto a field of play in order to prevent the soccer ball from becoming a tripping hazard. While the device described in this detailed description is referred to as a "soccer goal," it should be understood that this design could also be used for any sporting event in which a net is required, including, for example, lacrosse, field hockey, etc.

The soccer goal 10 includes an entryway 12, formed by a front crossbar 14, a first vertical support post 16, and a second vertical support post 18, where a ball may pass into the goal. This entryway area 12 is generally referred to as the front of the goal and is where the goalie usually stands during gameplay to defend against opposing players kicking the ball into the goal. The entryway 12 may be formed in various sizes depending on the intended use of the soccer goal. For example, for adult use the entryway 12 may be approximately 8 feet wide and 24 feet wide. In other embodiments, the entryway 12 may be sized for junior players, having a height of about 4 feet to about 7 feet and a width of about 6 feet to about 21 feet. Next, a base of the goal 10 is formed by a first elongate lower support bar 20 and second elongate lower support bar 22 that are secured to bottom ends of the first vertical support post 16 and second vertical support post 18, respectively and extend perpendicularly away from the entryway 12. A lower back crossbar 24 is positioned perpendicularly between of the first lower support bar 20 and second lower support bar 22 at ends of the support bars 20 at 22 distal from the vertical support posts 16, 18. In certain embodiments, the base (lower back crossbar 24 and the lower support bars 20, 22) may be configured to secure the goal in position. For example, portions of the base may include vertical holes that are configured to receive ground attachment devices, such as ground spikes. These spikes could be passed through the goal 10 and into the ground in order to anchor the goal to the ground. For example, spikes may be inserted through the support bars 20, 22 or through the lower rear crossbar 24 or both.

Additionally, the goal 10 may be designed so as to be easily movable from one place to another. In this regard, the materials selected for the construction of the goal 10 are preferably lightweight in order to facilitate the easy transport of the device. However, the material selected should also be sturdy in order to withstand stresses placed on it during use. For example, all support members and cross members may be constructed of aluminum, steel, PVC pipe, and other suitable materials.

Additionally, in certain embodiments, the goal 10 may also include permanently or temporarily mounted wheels on the base of the goal. For example, one or two wheels may be mounted on either side of the goal. These wheels may be placed adjacent the entryway 12 of the goal where the lower support bars 20, 22 meet the vertical support posts 16, 18. Alternatively, the wheels may be mounted at the back of the goal 10, where the lower support bars 20, 22 meet angled first and second lower net supports 28, 30 Alternatively, the wheels may be mounted where first and second lower net supports 28, 30 meet upper back crossbar 32 or where the upper legs 40, 42 meet lower legs 48, 50. Preferably, when equipped with two wheels, the goal 10 can be easily moved by tilting the goal up onto the wheels. The wheels are positioned so that then the goal is sitting on the ground in its operable position, the when is level with the bottom of the supports 20, 22. In this way, the goal is resting on the supports 20, 22 in this position and not on the wheels. When the goal is tilted, the wheels make contact with the ground and the goal is lifted up off of the ground surface. This enables a single person to easily transport the goal. Alternatively, when equipped with four wheels, no titling would be required. Additionally, the wheels may include a locking mechanism to prevent the wheels from moving when such movement is not desired.

The soccer goal 10 further includes a lower open portion or a lower-sloped portion 26, which is generally formed between the lower support bar 24, a first lower net support 28, a second lower net support 30, and an upper back crossbar 32. The lower ends or bottoms of the net supports 28, 30 are connected to support bars 20, 22, respectively, and extend upwards at an angle $\pi$ relative to an axial length of the support bars. Angle $\pi$ may vary from about 0° to about 90°. Preferably, angle $\pi$ is about 30° to about 60°. The upper ends or tops of the supports 28, 30 are connected to the upper back crossbar 32. The upper back crossbar 32 extends perpendicularly between the lower net supports 28 and 30 and is parallel to the lower back crossbar 24. The lower sloped portion 26 is an opening formed by the structural components of the goal 10. A lower net portion or simply net 34 may secured over the lower sloped portion 26. In particular, the net 34 may be secured between the net supports 28, 30, the lower back crossbar 24, and the upper back crossbar 32. The combination of the lower-sloped portion 26 and the lower net portion 34 is referred to throughout this description as the return netting area. Preferably, the lower portion 34 is positioned in the return netting area such that a soccer ball is unable to pass through the lower sloped portion 26 of the soccer goal 10. Also, the lower net portion 34 is preferably tensioned to provide a relatively firm surface.

It should be noted that the lower back crossbar 24 may be formed using either a structural component, such as that used for other portions of the goal 10, or it may be made from a less expensive, flexible material such as a rope. However, one benefit of forming the lower back crossbar 24 out of structural components is that it provides a positive containment of the ball.

Figure 15:
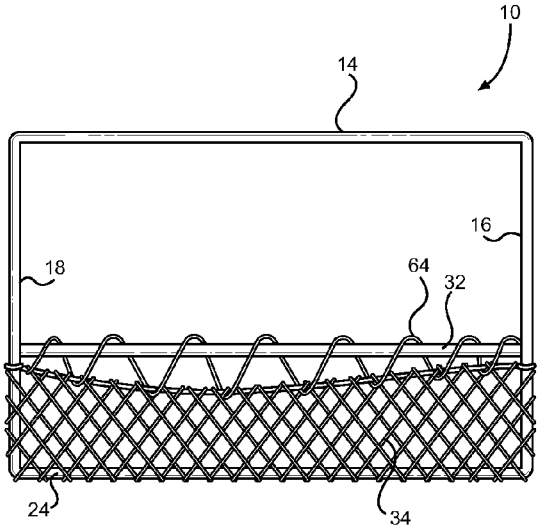
FIG. 15 is front view of the returning goal system shown in 14 showing the tensioning rope in an un-tensioned position.
Figure 19:
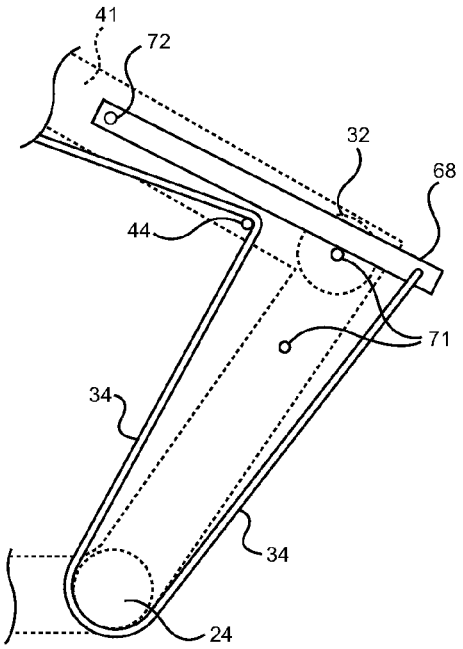
FIG. 19 is a side view that demonstrates an embodiment of returning goal system shown in the tensioned position.
Figure 20:
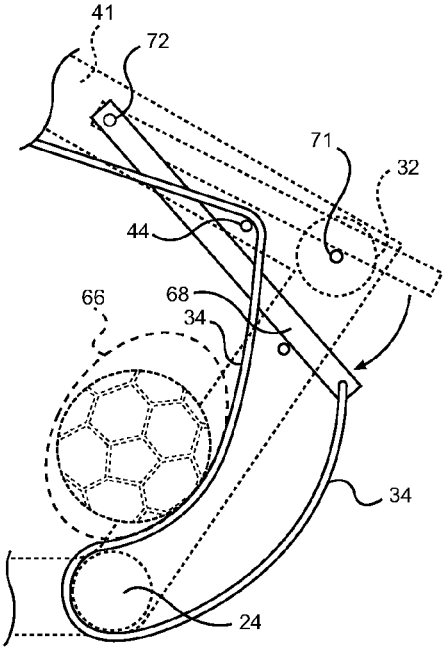
FIG. 20 is a side view of the returning goal system shown in 18 where the lever-type net tensioning mechanism is shown in the un-tensioned position.

As demonstrated in FIGS. 15, 19, and 20, the lower net portion 34 may be secured to the back crossbars 24, 32 such that the net is reinforced to prevent a soccer ball from being forcefully kicked through the lower sloped portion 26. In particular, the lower net portion 34 may be secured to the upper back crossbar 32 and then wrapped around and optionally secured to the lower back crossbar 24. Alternatively, after wrapping the lower net portion 34 around the lower back crossbar 24, the net is then pulled taut and the opposite end of the net is then attached to the upper back crossbar 32. The ends of the net portion 34 may be attached to the upper back crossbar 32 at the same or different anchoring or attachment locations. By wrapping the net portion 34 around the lower back crossbar 24 in this manner, two layers of netting are created for preventing a soccer ball from passing through the lower sloped portion 26 and a more secure attachment of the net is provided, thereby eliminating a common failure point of previously designed soccer goals where the net is attached to a back crossbar. Additionally, wrapping the net 34 around the lower back crossbar 24 allows for tensioning and un-tensioning of the net, which will be explained in greater detail below. A particular advantage of wrapping the net 34 in front of the lower back crossbar 24 is that it assists in preventing balls from becoming trapped behind the lower back crossbar 24 when that is not desired, such as when the netting 34 is in a taut or tensioned position.

Referring again to FIG. 1, the soccer goal 10 further includes an open upper portion or an upper-sloped portion 36, which is generally formed between the front crossbar 14, the upper back crossbar 32, a first upper net support 41, and a second upper net support 43. As with the lower sloped portion 26, the upper sloped portion 36 formed by the structural components of the goal 10. An upper net portion or simply net 38 may secured over the upper sloped portion 36. The first upper net support 41 includes a first upper leg 40, which is secured adjacent the connection of the front crossbar 14 and first vertical support post 16, and a lower leg 48. The legs 40, 48 are connected together at an angle such that the upper leg 40 extends away from the first vertical support post 16 at an angle $\Theta$ of about 0° to about 70° relative to the support bar 20. The lengths of the legs 40, 48 may vary according to different embodiments.

Figure 13:
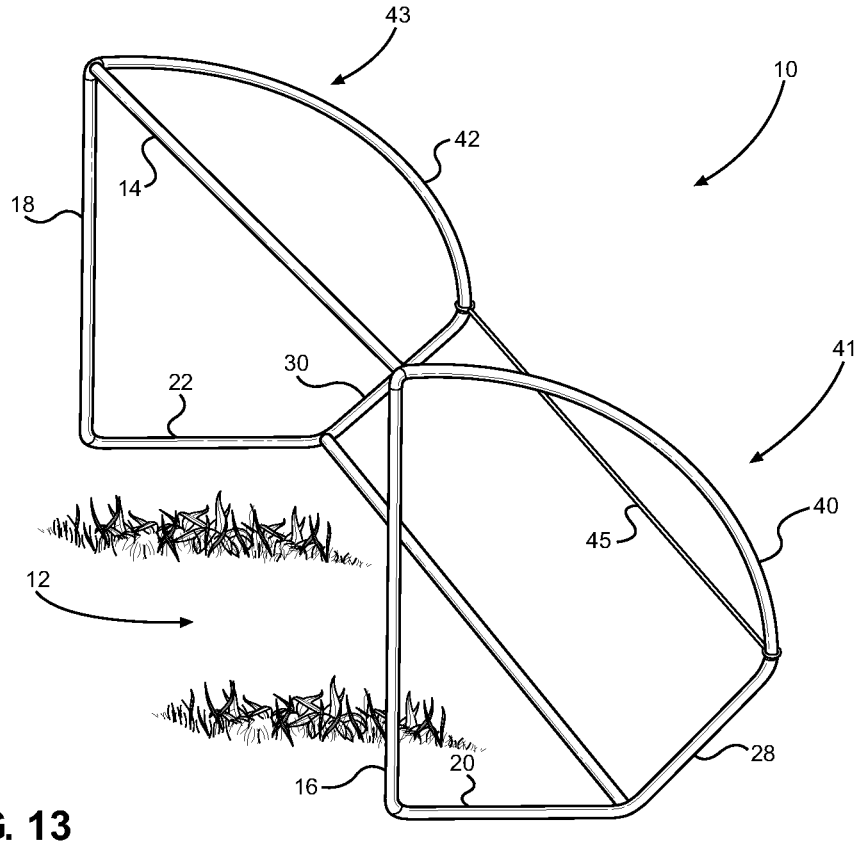
FIG. 13 is a front perspective view of a returning goal system having curved upper net supports.

In certain embodiments, additional connected legs may be provided, such as a three- or four-piece upper net support. On the other hand, the lower legs 48,50 may be eliminated altogether such that the upper legs 40, 42 are directly connected with the net supports 28, 30 or upper back crossbar 32. In certain other embodiments, the upper leg 40 may be curved, as depicted in FIG. 13. In this or other embodiments, the upper back crossbar 32 depicted earlier may be replaced with a cross member, such as a rope 45, which may supply support and tension to the netting and also to ensure that the netting in the upper open portion is maintained at the correct angle. The rope 45 may be moved to any position along the upper net supports 41, 43 or the lower net supports 28, 30. This embodiment may employ multiple nets to cover the open area 26, 36, as discussed in earlier embodiments. However, preferably, a single net is used. In particular, the upper net 38 stretches from the front crossbar 14, along the net supports 41, 43, over the rope 45, and then attached to the lower support bar 24 in the manner described above, which may include multiple layers of netting.

Returning again to FIGS. 1 and 2, the second upper net support 43 has a structure that corresponds identically to the first upper net supports 41, including a second upper leg 42 and lower leg 50.

Figure 23:
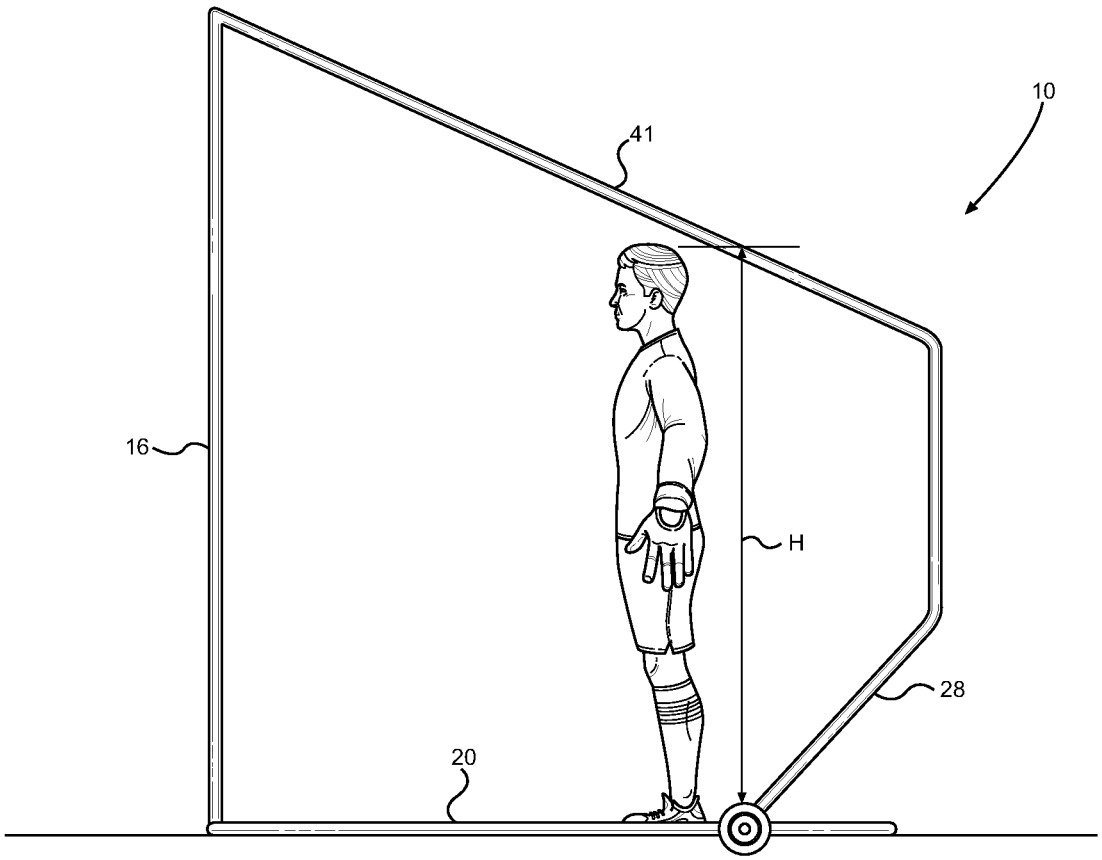
FIG. 23 is a side view of an embodiment of the returning goal system illustrating a the height H of the netting.

An upper net 38 may be secured between the net supports 41, 43, front crossbar 14, and upper back crossbar 32. In certain embodiments, the upper net 38 is slack or loose relative to the lower net 34, such that the upper net 38 may absorb a soccer ball kicked into the soccer goal 10 instead of cause it to be returned out of the goal. In certain embodiments, to prevent the upper net 38 from sagging, one or more supports 44 may be secured between the upper net supports 41, 43. Preferably, the net 38 is attached such that a player can enter the goal 10 and retrieve the ball without contacting the net or having to push the net out of the way to reach toward the lower back crossbar 24. As shown in FIG. 23, this height H may vary according to the age or size of the player. For example, the height H for an older or taller player would be greater than the height H for a younger or shorter player.

The support 44 may comprise a rope, a beam, a bar, etc. This configuration would allow a first portion of the upper net 38 to maintain a different angle from a second portion of the upper net. For example, the first portion of the upper net 38 may have an angle that is steeper with reference to the axial length of the support bars 20, 22 than the second portion of the upper net. The angle $\Phi$ formed between the first and second portions of the upper net may vary from about 90° to about 180°. In certain other embodiments, the upper net 38 is formed using two discreet pieces of netting. In another embodiments, the upper net 38 and the lower net 34 are formed using a single piece of netting.

Supporting the net 38 in this fashion creates a dome-like configuration, where the height of the net decreases and the angle or steepness of the net increases further into the goal. This curved shape causes the ball to be guided downwards along the surface of the net 38 to the ground or to the lower sloped portion 26 so that it may be returned.

In place of support ropes 44, alternative materials could be used such as a bar, pipe, etc. However, it is preferable to use a material that is flexible to prevent balls from bouncing out or being forcefully ejected. If a hard or stiff material is used to support from returning out of the goal 10. For example, balls entering the goal 10 may strike a stiff material and bounce out of the goal 10. On the other hand, using a flexible material such as a rope allows that portion of the net 38 and support 44 to move with the ball and to slow its movement and to guide the ball to the bottom of the goal 10. The number and configuration of support ropes 44 may vary. For example, one or more support ropes 44 may be configured in a X-shape to support the upper net 38. In another embodiment, support ropes 44 may be parallel to each other.

Figure 24:
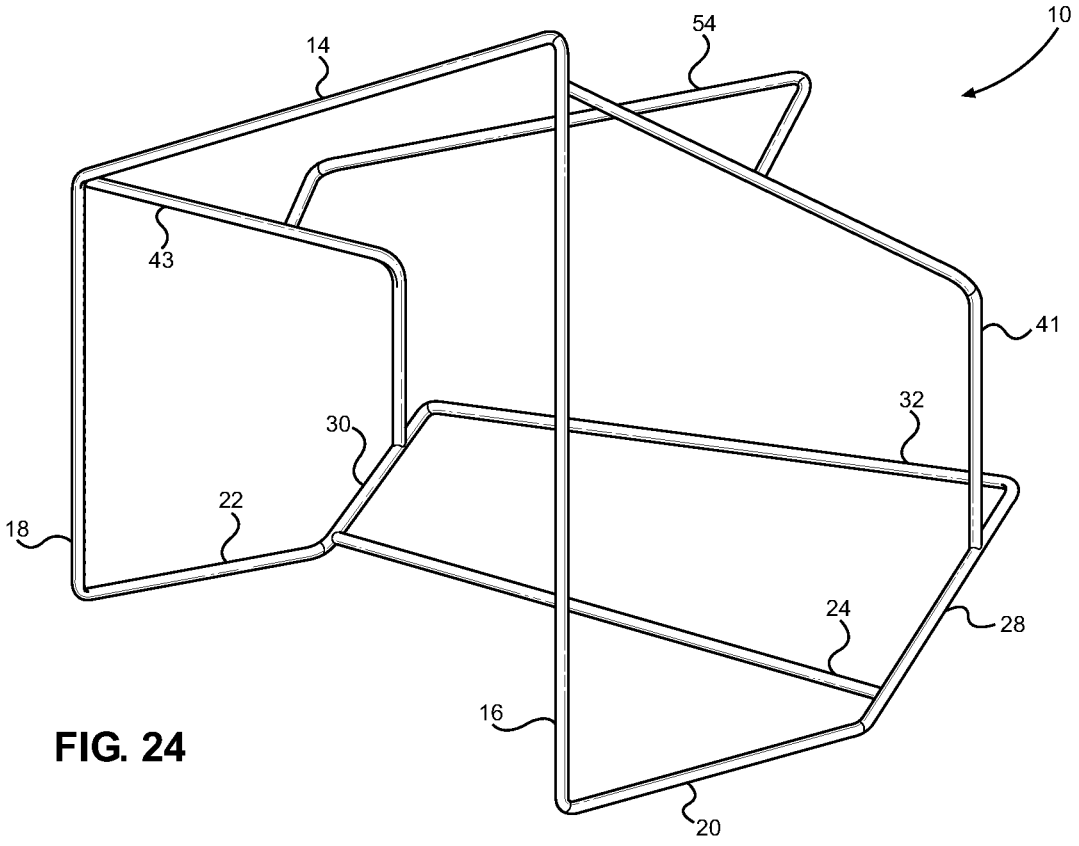
FIG. 24 is a front three-quarter perspective view of a returning goal system having an arched net support in accordance with embodiments of the present invention.

Next, as shown in FIGS. 3-12, in certain embodiments, the soccer goal 10 may include an arched net support 54 secured between the net supports 41, 43. The arched net support 54 is configured to assist in supporting the upper net 38 such that a player can enter the goal 10 and retrieve the ball without contacting the net or having to push the net out of the way to reach toward the lower back crossbar 24. The upper net 38 may be attached to the arched net support 54 to prevent the upper net 38 from sagging. Preferably, this attachment permits the upper net 38 to remain loose for absorbing the impact of a soccer ball kicked into the soccer goal 10 and to avoid the forceful ejection issue discussed above. One benefit of the curved or arched nature of the net support 54 is that it emphasizes the dome-like shape and further assists in guiding the ball to the return surface. FIG. 24 depicts an alternative net support 54 design that is not curved.

Returning now to FIG. 1, a first side opening 60 is formed by the first vertical support post 16, the first lower support bar 20, first lower net support 28, and the first upper net support 41. Similarly, a second side opening 62 is formed by the second vertical support post 18, the second lower support bar 22, second lower net support 30, and the second upper net support 43. Nets may be positioned in these openings 60, 62 in order to prevent a ball from escaping through the sides of the goal 10. These nets may be separate from other net portions, such as the upper net 38 and lower net 34. On the other hand, the side nets may be joined to these other net portions. For example, a single large net may be draped over the entire exterior or fastened to the interior of the goal.

Figure 4:
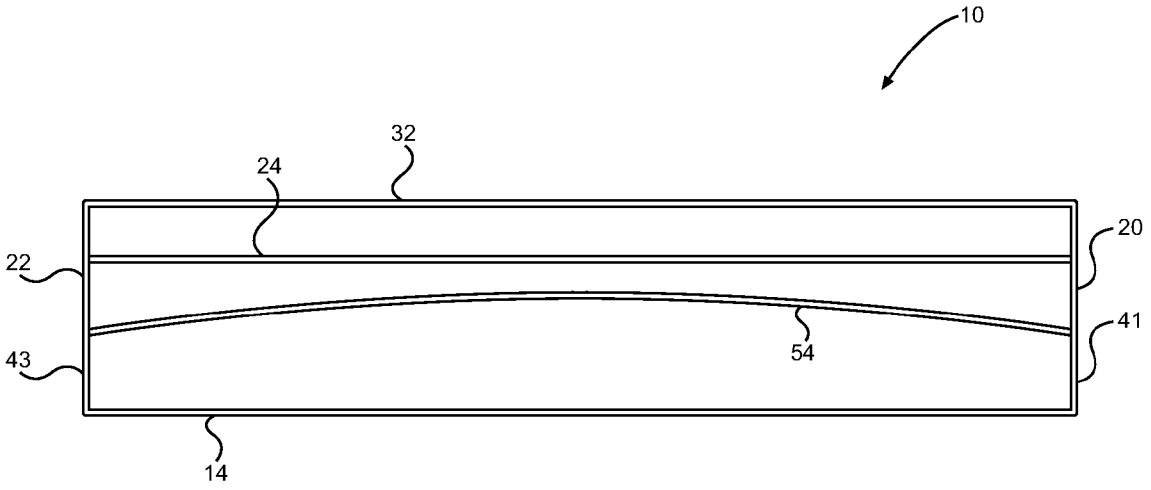
FIG. 4 is a top view of a returning goal system in accordance with embodiments of the present invention.
Figure 5:
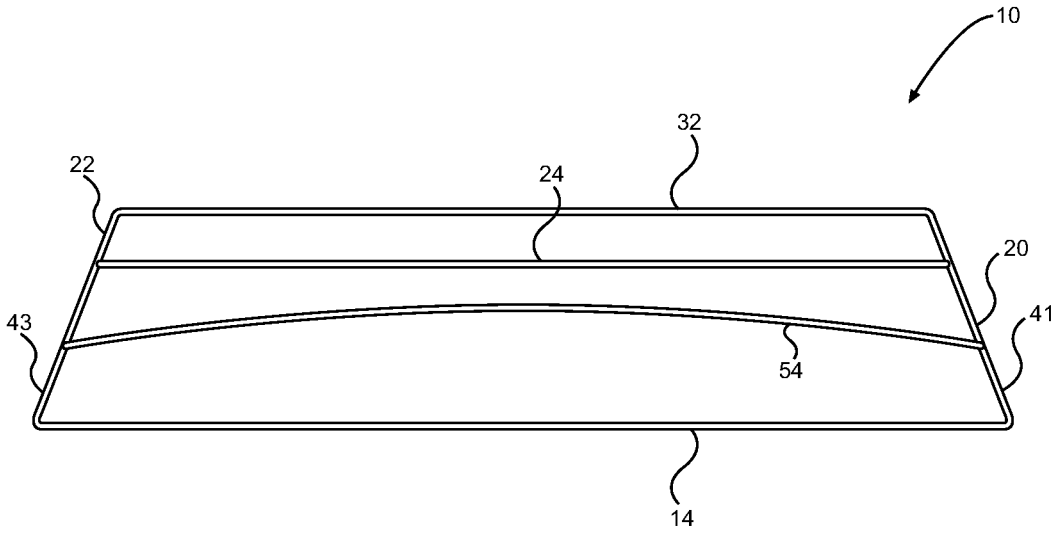
FIG. 5 is a top view of an alternate embodiment of a returning goal system having angled side surfaces.
Figure 6:
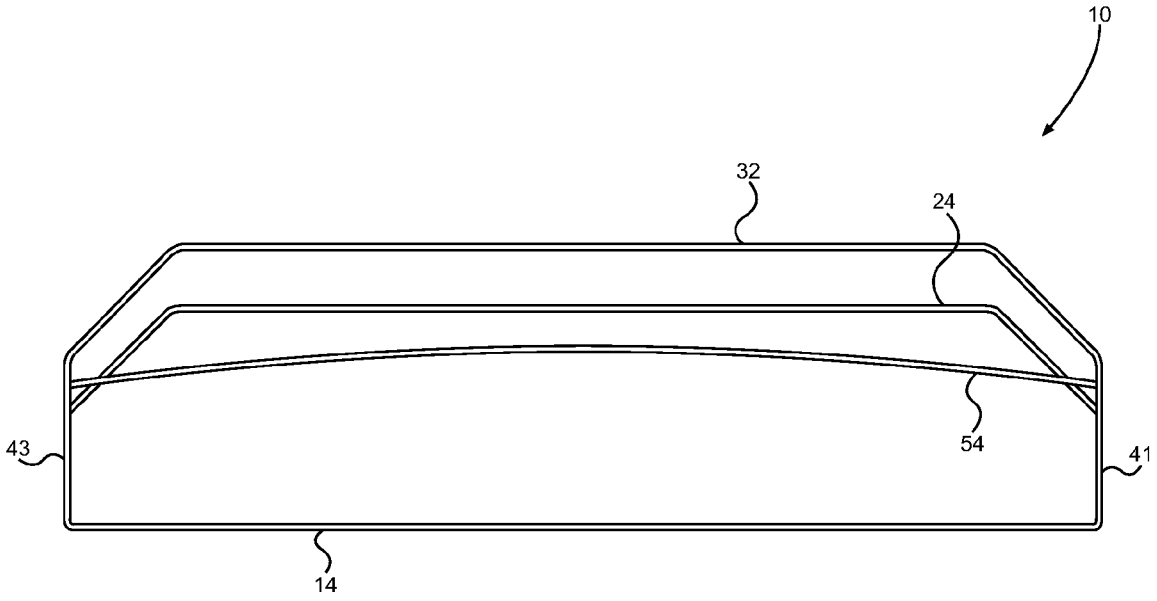
FIG. 6 is a top view of an alternate embodiment of a returning goal system having rear angled crossbars.
Figure 7:
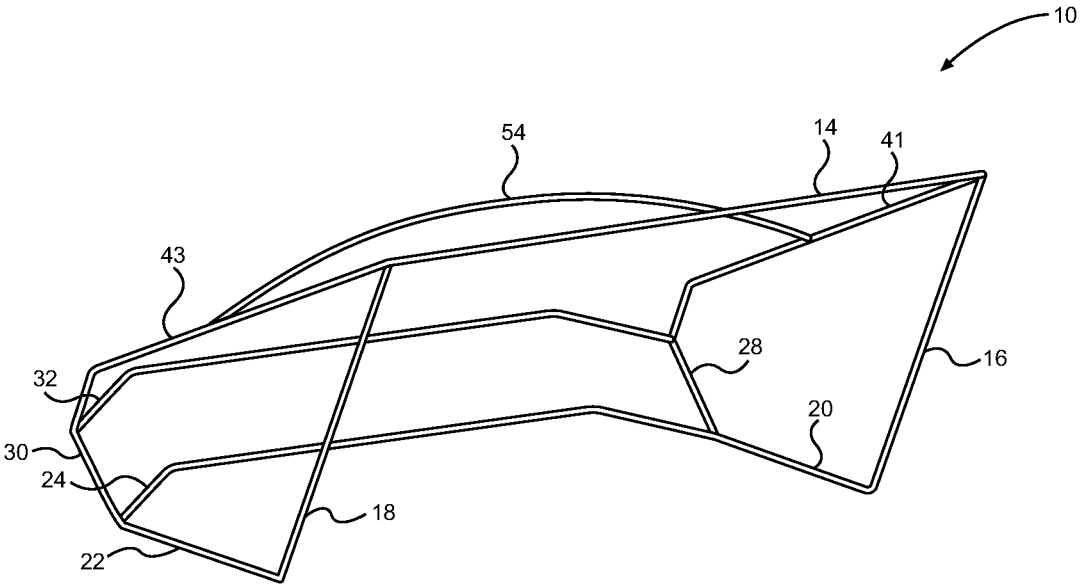
FIG. 7 is a front three-quarter perspective view of the returning goal system depicted in FIG. 6
Figure 8:
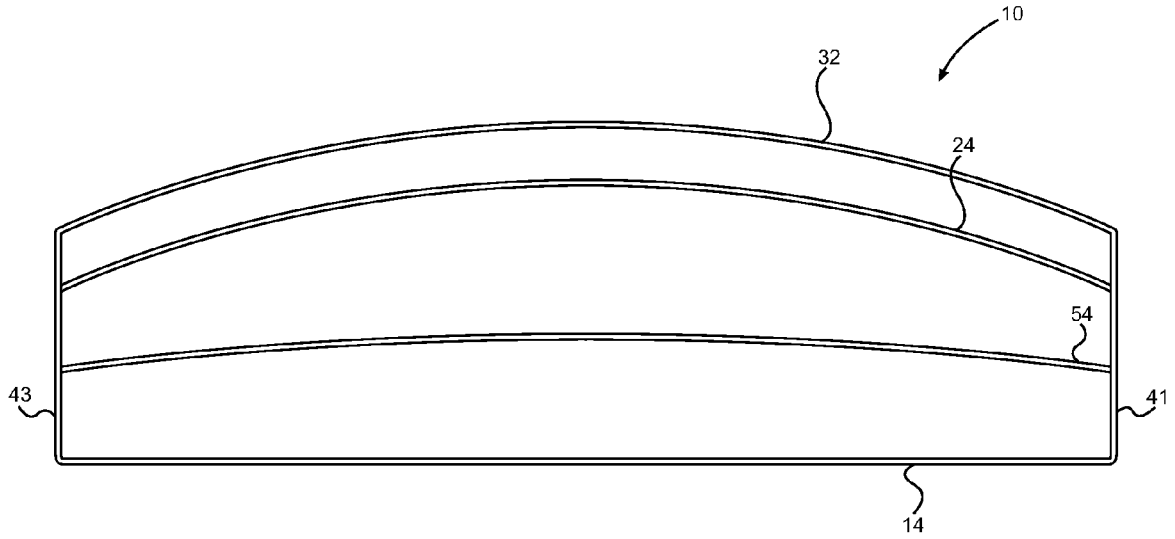
FIG. 8 is a top view of an alternate embodiment of a returning goal system having rear curved crossbars.
Figure 9:
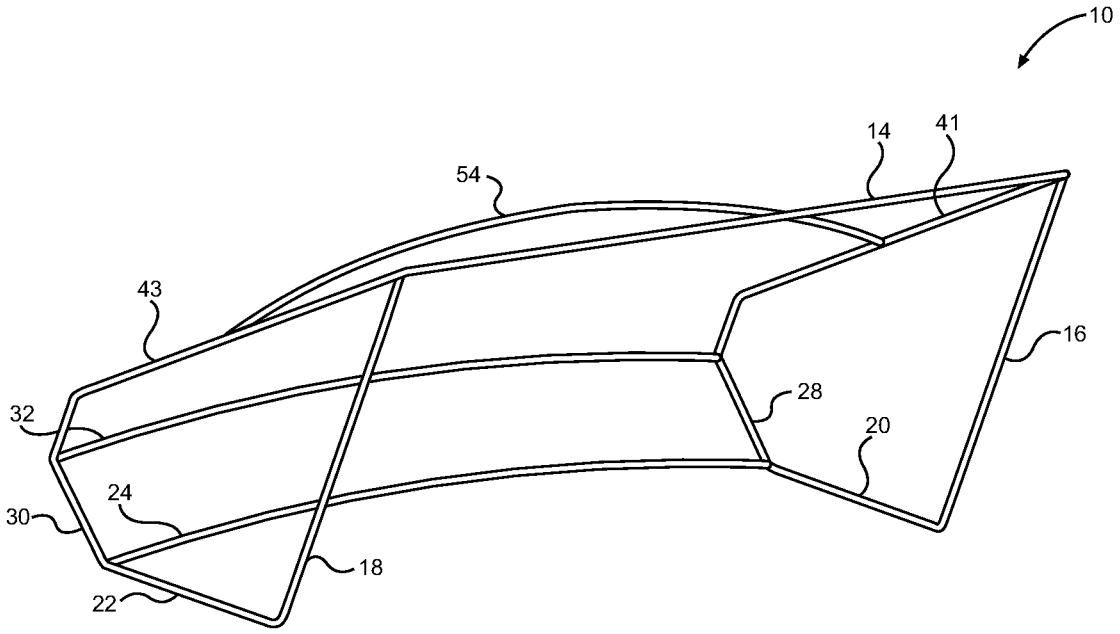
FIG. 9 is a front perspective view of the returning goal system depicted in FIG. 8.
Figure 10:
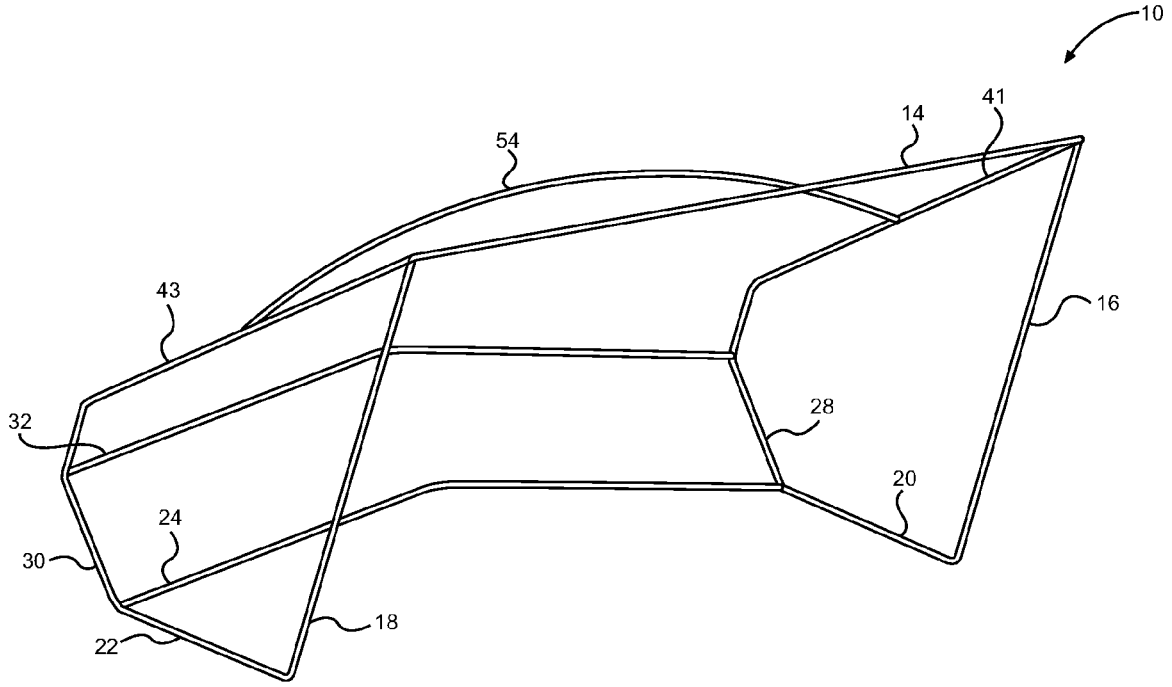
FIGS. 10-12 are front perspective views of returning goal systems having various rear crossbar configurations.
Figure 11:
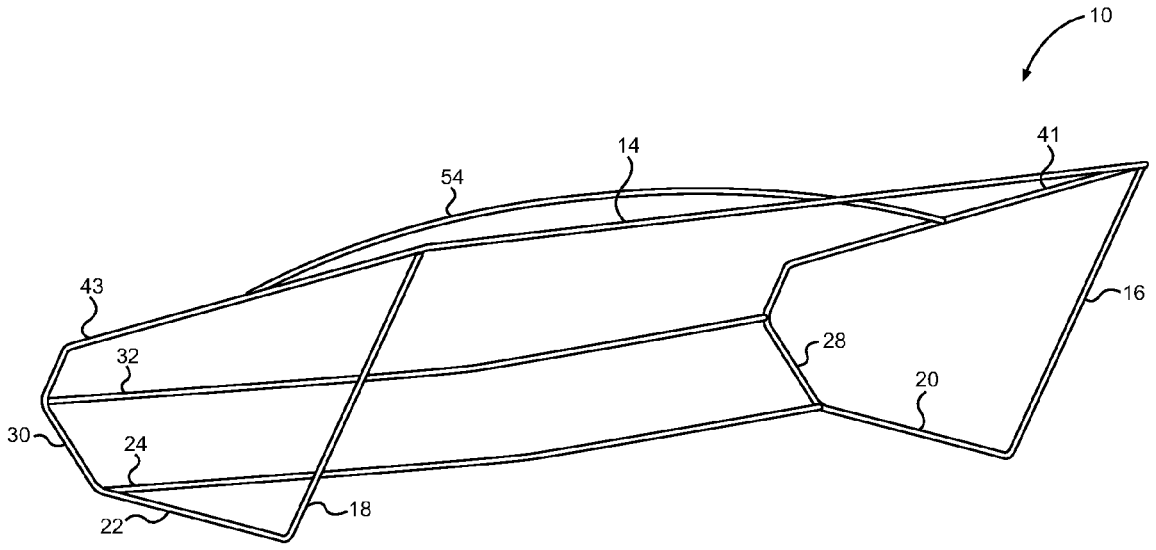
Figure 12:
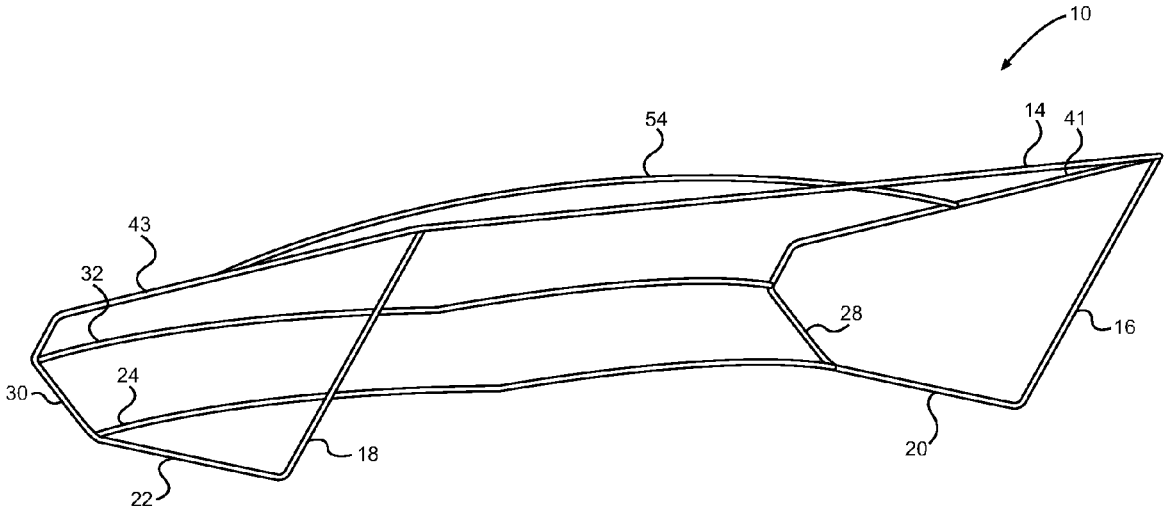

With reference to FIGS. 1 and 4, generally the various members that form the sides of the goal 10, including the support bars 20, 22 and upper and lower net supports 20, 22, 41, 43, are secured perpendicularly to the front crossbar 14 and back crossbars 24, 32. However, in another embodiment, illustrated in FIG. 5, the sides may angle in towards the back crossbars 24, 32.

Also, generally the back crossbars 24, 32 and net support 54 are substantially straight, as shown in FIG. 1. However, in certain embodiments, portions of the back crossbars 24, 32 and net support 54 may be angled or curved, as shown in FIGS. 6-12. The different shapes may serve different functions. For example, goals with inward angled crossbars 24, 32, such as those depicted in FIGS. 8-10, will tend to guide the balls towards the center of the goal and to dissipate the ball's energy. Additionally, this shape will change the direction that that ball is returned. For example the ball may be directed sideways out of the goal instead of directly out of the front of the goal. On the other hand, goals with outward angled crossbars 24, 32, such as in FIGS. 11 and 12, will tend to guide the balls to the sides of the goal 10.

Referring again to FIG. 1, the returning soccer goal 10 is configured to absorb the impact of a kicked soccer ball and return the soccer ball to the entryway 12 of the soccer goal 10. For example, the slack upper net 38 absorbs the force of a soccer ball entering the soccer goal 10 towards the upper-sloped portion 36 and then the ball falls to the tensioned angled lower net 34, which directs the ball toward the front of the goal where it may then be safely retrieved quickly and safely.

The goal 10 provides several advantages over prior similar devices. First, unlike other rebounding soccer goals, which forcefully return the soccer ball, the soccer goal 10 advantageously gently returns the ball to the front of the goal without ejecting it into the field of play. Additionally, with reference to FIG. 23, since the ball is not forcefully ejected from the goal 10, the goal may be used with a player positioned in the entryway 12 of the goal, such as a goalie, without fear that the player will be struck by a ball exiting the goal. Additionally, since the lower back crossbar 24 is positioned closer to the front of the goal 10 than the upper back crossbar 32, and because the upper net 38 is sloped towards the upper back crossbar 32 instead of the ground, a user is able to walk upright towards the lower back crossbar 24 to retrieve a soccer ball without having to bend or kneel to avoid the upper net 38.

As described above, the goal employs one or more nets that may be arranged in various configurations. In certain embodiments, portions of the nets may be tensioned or un-tensioned. When tensioned, the ball will be gently returned to the front of the goal as discussed above. On the other hand, when un-tensioned, the return netting will capture and retain the ball(s) in a return net area, much like traditional goals do. In that case, a sharp pull on the un-tensioned area of the net will briefly re-tension the netting, thereby ejecting the ball(s) towards the front of the goal. As such, a player may selectively choose for each ball kicked into the goal 10 to be returned automatically or to be captured by the net until ejected and returned manually. Therefore, the goal 10 can selectively operate in two different modes: a practice only mode, where each ball is immediately returned, or a game mode, where balls are collected and then manually returned.

Since certain portions of the net may operate independently from one another or be tensioned or un-tensioned independently from one another, two or more separate nets may be employed so that one net may remain static in either a tensioned or un-tensioned state, while a second dynamic net can transition from a tensioned to un-tensioned state and vice versa.

Figure 14:
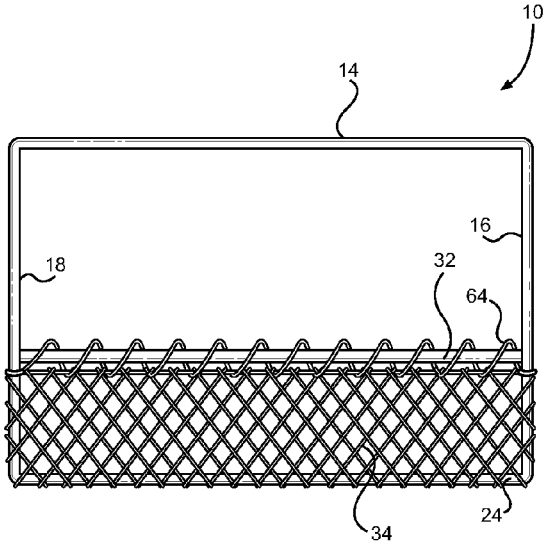
FIG. 14 is a front view of the returning goal system having a rope-type net tensioning mechanism show the tensioning rope in a tensioned position.

Provided are various embodiments for tensioning and un-tensioning the return netting area. With reference to FIGS. 14 and 15, the first method is through a rope tensioning method, which relies on one or more tensioning ropes 64 secured together with the lower net 34 and goal 10 in either a tightened or slackened position in order to tension or un-tension the net, respectively. The tensioning rope 64 is threaded through openings in the net 34 and then wrapped about the upper back crossbar 32. In a tensioned positioned, such as in FIG. 14, the rope 64 is tightly wrapped around the upper back crossbar 32. The goal 10 shown in FIG. 15 depicts the net 34 in an un-tensioned state, where the rope 64 is loosely wrapped around the upper back crossbar 32. This depiction is not to scale and is exaggerated for the purpose of clarification only. Additionally, while FIGS. 14 and 15 show a net 34 that extends only from the lower back crossbar 24 to the upper back crossbar 32, the net could extends to the front crossbar 14, as previously discussed.

Figure 16:
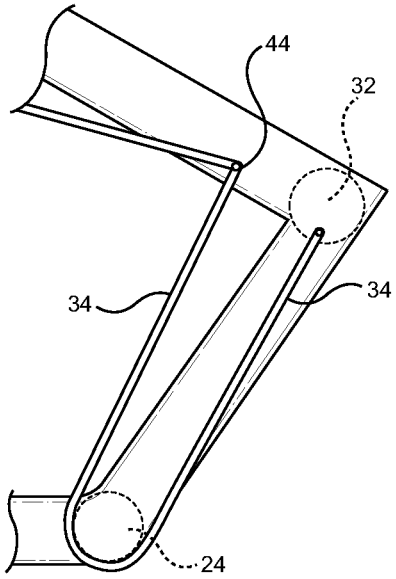
FIG. 16 is a side view of a rope-type tensioning mechanism shown in the tensioned position.
Figure 17:
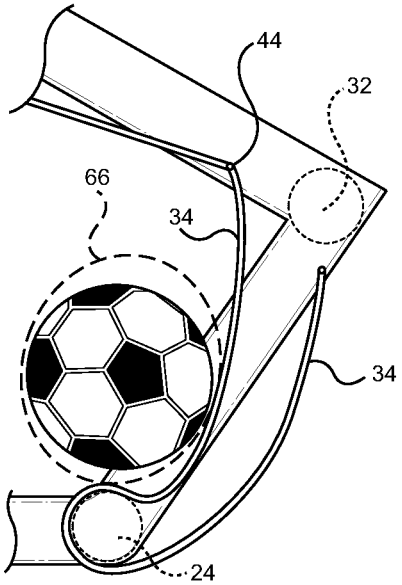
FIG. 17 is a side view of a rope-type tensioning mechanism shown in the un-tensioned position.

FIGS. 16 and 17 illustrate a second embodiment of the rope tensioning method and also illustrate the differences between the tensioned and un-tensioned states. In particular, FIG. 16 demonstrates a rope tensioning mechanism wherein the net 34 passes above support 44 (FIG. 2) or rope 45 (FIG. 13), changes direction and then passes under the lower crossbar 24. The net 34 then extends upwards to the upper back crossbar 32, where it is connected using a rope, as discussed above. The net 34 is shown in a tensioned position. A ball entering the goal 10 would contact the surface of the net and then be immediately returned towards the front of the goal. FIG. 17 demonstrates the slackened or un-tensioned position. In this position, the ropes connecting the net 34 to the upper crossbar 32 are loosened so that a pocket 66 is formed by the slack in the netting 34. When in this position, a ball would fall into the pocket 66 and would come to rest behind the lower crossbar 24. As mentioned earlier, to remove balls from this pocket 66, a player could quickly pull the net 34 to briefly place it under tension.

A second method for tensioning and un-tensioning the net 34 is by attaching an end of the net at various locations along the periphery of the portions of the upper back crossbar 32. For the example, in an un-tensioned position, the net 34 may be connected along the bottom surface of the upper back crossbar 32, which would provide slack in the net. In a tensioned position, the net 34 may be connected along the top surface of the upper back crossbar 32, which would eliminate the slack in the net and cause it to be taut. In another embodiment, the net 34 may be attached in one location to the upper back crossbar 32. The upper back crossbar 32 may then be rotated and locked into one or more positions in order to tension or un-tension the net 34. The net 34 may be locked into place using pins, friction collar or ratcheting-type mechanisms.

Figure 18:
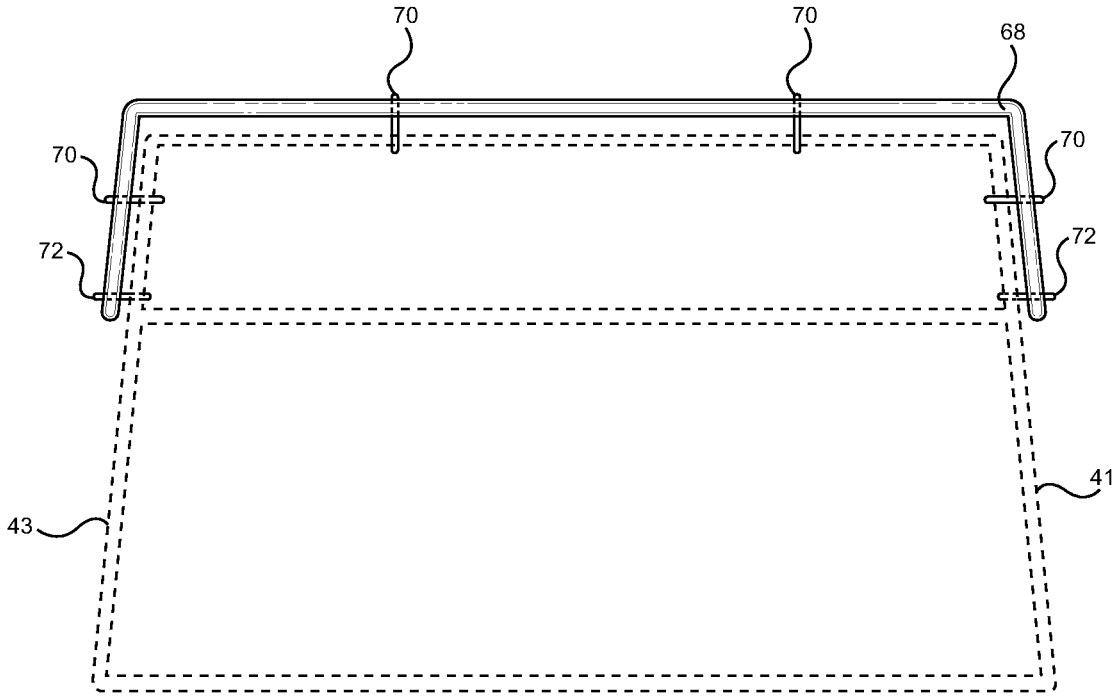
FIG. 18 is a top view demonstrating a returning goal system having a lever-type net tensioning mechanism and position pins.

A third way that the return netting may be tensioned is through a lever-type tensioning mechanism, which is depicted in FIGS. 18-20. The lever-type tensioning mechanism works almost identically as the rope-tensioning mechanism, except that the free end of the net 34 is connected to a lever arm 68 that is generally u-shaped and extends from the outside of one side of the goal 10, along the length of the goal and then to the outside of the opposite side of the goal. In another embodiment, the lever arm 68 is positioned insider the frame of the goal. The net (not shown) may be connected to the arm 68 along the elongate central portion of the arm. Unlike the rope tensioning method, once the net is connected to the arm 68, the net can be tensioned and un-tensioned without loosening that connection.

The arm 68 may be secured in a tensioned or un-tensioned position using a plurality of pins 70 which may be inserted into holes 71 placed at various points in the goal. An advantage of this design is that the entire length of the net can be moved from the tensioned position to the un-tensioned position at the same time and vice versa. FIG. 19 illustrates the lever arm 68 in a tensioned position. The arm 68 is preferably mounted to an exterior surface of the upper net supports 41, 43 using a connection member 72, such as a bolt. The arm 68 then extends towards the rear of the goal 10 and is preferably configured to extend beyond the rear surface of the goal. The arm 68 freely pivots about the connection member 72 from the tensioned position in FIG. 19 to the un-tensioned position shown in FIG. 20. The arm 68 may be secured in place using a plurality of pins 70 that may be inserted through the holes 71 in the goal 10.

As mentioned previously, the goal 10 may be used for a number of different sports including soccer, lacrosse, field hockey, etc. While typical full-size soccer goals are typically 8 feet tall by 24 feet wide, goals used for other sports may be significantly smaller. For example, a full-size lacrosse goal is only 6 feet tall by 6 feet wide. Additionally, the size of goals may vary depending on the age or classification of the players involved. For example, in youth soccer leagues, goals are often significantly smaller than the full-size versions, and goals for middle school leagues may be smaller than goals for high school leagues.

Obtaining multiple goals of different sizes to accommodate different players is often difficult for leagues and schools for several reasons. The first reason is cost. Purchasing multiple goals and maintaining them with the required netting could be very expensive, especially for schools and leagues with limited budgets. The next reason is space. Goals are large and require a lot of space for storage. Finally, goals are often staked into the ground and are also large and bulky and, therefore, it is difficult to move a goal of one size, such as a soccer goal, and replace it with a different goal of a different size, such as a lacrosse goal.

Figure 21:
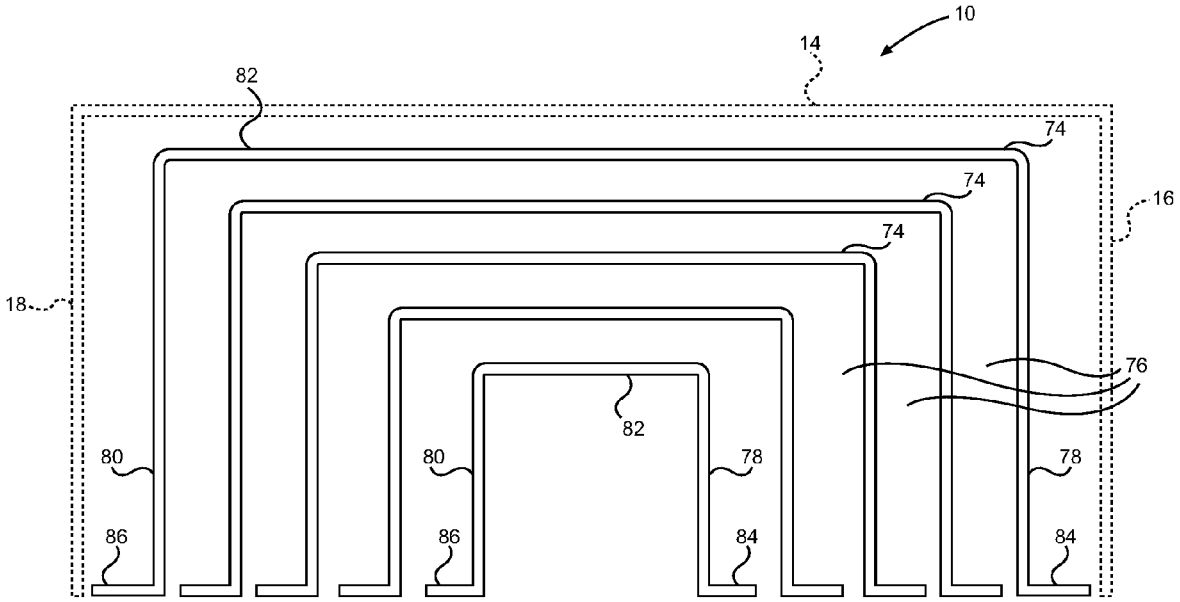
FIG. 21 is a front view depicting a set of nested facings in accordance with embodiments of the present invention.

The present invention overcomes each of these problems. As shown in FIG. 21, there is provided a system of nested facings 74 that may be inserted within and mounted to the entryway 12 of the goal 10. The purpose of the facings 74 is to effectively reduce the size of the entryway 12 of the goal 10 by obstructing various amounts of the entryway opening. By blocking specific portions of the entryway 12, various sized entryway openings 76 are created. These openings 76 may be sized to conform to the goal openings for various sports and for various leagues. This allows a single goal 10 to be used in connection with a wide range of sports or leagues, each having different goal opening 76 sizes, that does not require repositioning or moving the goal. This would permit a school to purchase a single goal 10 that was large enough for its largest goal needs and then select facings 74 that would create other goal sizes that the school required. For example, a school that needed a full size soccer goal and a lacrosse goal could purchase an 8'×24' goal and a 6'×6' facing 74. In that case, a single goal could serve as both a full size soccer goal and a lacrosse goal, without the added expense or room requirements of buying and storing two separate goals.

Each of the facings 74 includes a generally U-shaped interior frame that defines the goal opening 76. The frame is comprised of a first vertical member 78 and a second vertical member 80 connected to opposite ends of a top member 82. A first connection member 84 and a second connection member 86 connect the first and second vertical members 76, 78, respectively and connect the facing 74 to the goal 10, which provides additionally stability to the goal. Netting (not shown) is disposed along the outer perimeter of the facing 74 and is sized and configured for connection to the goal 10. In particular, this netting is connected to the front crossbar 14, first vertical support post 16, and second vertical support post 18. This netting serves to block balls from entering the goal 10 at any point except the opening 76. This design also has the added benefit of stopping missed shots on the goal so that players can quickly retrieve the ball.

Figure 22:
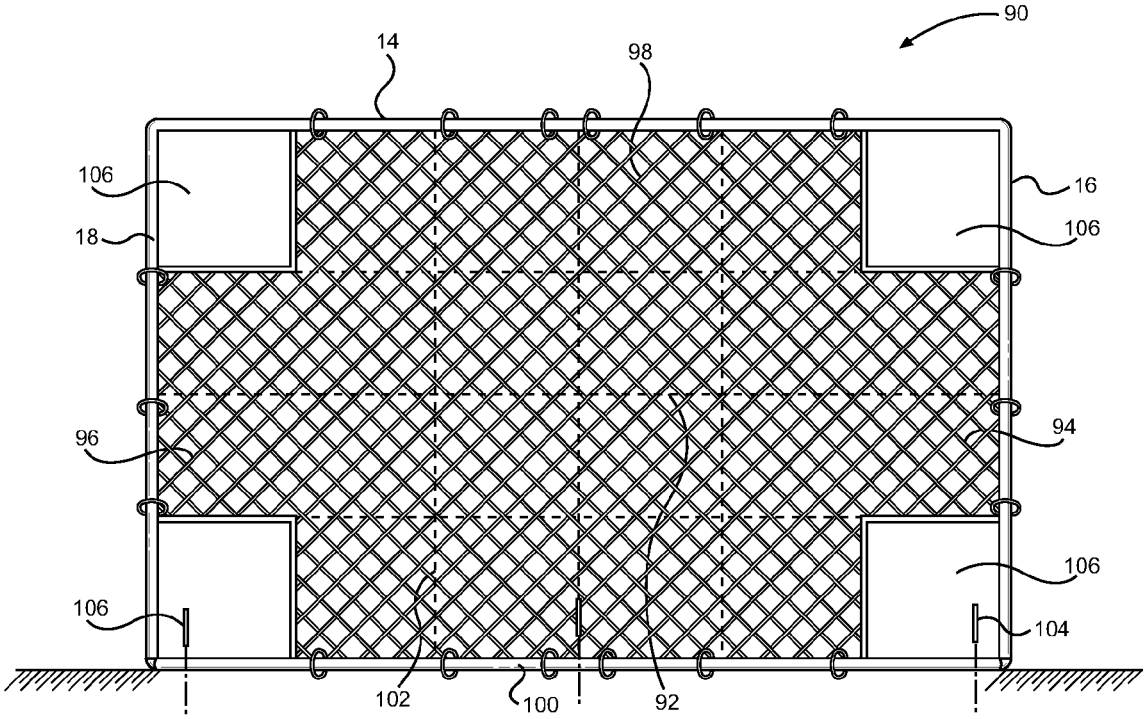
FIG. 22 is a front view depicting a returning goal system having a targeting net facing attached to the goal front.

In addition, the goal 10 may include a targeted kicking practice net 90, as depicted in FIG. 22. The purpose of this net 90 is to train players to kick the ball away from the goalie by kicking the ball into sides and corners of the goal 10. The net 90 is generally shaped like a cross, including a large central portion 92 and four extensions that extend outward from the central portion.

The extensions are sized to connect as needed to the aforementioned facings or to the goal 10. For example, a right extension 94 may be connected to the front crossbar 14 first vertical support post 16, a left extension 96 may be connected to the second vertical support post 18, and a top extension 98 may be connected to the front crossbar 14. In certain embodiments, the net 90 may also include a removable lower crossbar 100 that is connected to the first and second vertical posts 16, 18 and that forms a fourth side at the entryway 12. A bottom extension 102 of the net 90 is connected to the lower crossbar 100. The lower crossbar 100 may include a plurality of securing members 104, such as ground spikes, to secure the front crossbar into the ground. One benefit of the lower crossbar 100 is that it may be used to roll up the removable practice net 90 for storage when not in use.

With the net 90 in place, four openings 106 are formed in each of the corners of the goal. Additionally, the net 90 may also include a vertical slit that will permit easy access in order to retrieve balls that have been kicked into the goal 10. As mentioned above, the purpose of these openings 106 is to train players to kick the ball into the corners and into the goal 10 via these openings. The central blocked portion 92 and extensions may represent a defender who is defending the goal 10. The difficulty of kicking into the goal 10 with the net 90 may be raised or lowered by attaching or removing portions of the net 90. For example, the left and right extensions 94, 96 may be removed so that the net 90 is a single column that blocks only the middle of the goal but leaves the sides open. Alternatively, the top and bottom extensions 98, 102 may be removed or folded so that the net is a single row that leaves the top and bottom of the goal open. Additionally, the top or the bottom of the net 90 may be folded in half to reveal the bottom or top of the goal entryway 12, respectively.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A dual-purpose convertible goal system for converting between a ball-retaining gameplay mode and a ball-returning practice mode, the goal system comprising:

a generally U-shaped entryway defined by:

an elongate front crossbar having a first end and a second end;

a first vertical support post having a top and a bottom, the top of the first support post attached to the first end of the front crossbar; and a second vertical support post having a top and a bottom, the top of the second support post attached to the second end of the front crossbar;

a first side extending away from the entryway proximate the first end of the front crossbar and defined by the first support post, a first lower support bar that is connected at a first end to the bottom of the first support post, a first lower net support having a bottom end connected to the first lower support bar, and a first upper net support having a bottom end that is connected between the bottom end and a top end of the first lower net support and a top end that is connected to the U-shaped entryway;

a second side extending away from the entryway proximate the second end of the front crossbar and defined by the second support post, a second lower support bar that is connected at a first end to the bottom of the second support post, a second lower net support having a bottom end connected to the second lower support bar, and a second upper net support having a bottom end that is connected between the bottom end and a top end of the second lower net support and at top end that is connected to the U-shaped entryway;

a lower back crossbar connected to and extending between second ends of the first and second lower support bars;

an upper back crossbar connected to and extending between the first and second lower net supports;

a lower open portion disposed between the first and second sides and defined by the upper and lower back crossbars, and the first and second lower net supports;

an upper open portion disposed between the first and second sides and defined by the front crossbar, the upper back crossbar and the first and second upper net supports; and a net connected to the goal and forming a netted enclosure behind the entryway and an open space located within the netted enclosure behind the entryway and in front of the lower back crossbar, the net covering the lower open portion and upper open portion, wherein the lower open portion of the net is sufficiently tensioned in the practice mode so as to return a ball into the open space and the net is sufficiently loosened in the gameplay mode to retain the ball in the net.

2. The returning goal system of claim 1 wherein the net further comprises an end that is passed beneath the lower net support and connected to a portion of the goal in order to form two adjacent layers of netting at the lower open portion.

3. The returning goal system of claim 1 further comprising a lever-type net tensioning mechanism for selectively tensioning and un-tensioning at least a first portion of the net covering the lower open portion of the goal, the mechanism comprising:

a generally U-shaped lever arm, including two connection arms and a central portion disposed between the connection arms operable for connecting to an end of the net, wherein the connection arms are rotatably mounted to outer faces of the upper net support; and a plurality of pin-type connection members operable for securing the lever arm in a tensioned or an un-tensioned position.

4. The returning goal system of claim 3 wherein the net further comprises an end that is passed beneath the lower net support and connected to the central portion of the lever arm in order to form two adjacent layers of netting at the lower open portion.

5. The returning goal system of claim 4 wherein a pocket is formed by the net within the lower open portion when the lever is in the un-tensioned position such that a ball striking the net at the lower open portion is trapped by the pocket.

6. The returning goal system of claim 1 further comprising a rope-type net tensioning mechanism, the mechanism comprising:

a tensioning rope interwoven with the net between the first and second sides of the goal proximate the lower open portion and mounted to upper crossbar that is tensioned in the practice mode to pull the portion of the net between the lower and upper crossbars taut and loosened in the gameplay mode to loosen the portion of the net between the lower and upper crossbars.

7. The returning goal system of claim 3 wherein the net further comprises an end that is passed beneath the lower net support and connected to the central portion of the lever arm in order to form two adjacent layers of netting at the lower open portion.

8. The returning goal system of claim 7 wherein a pocket is formed by the net within the lower open portion when the lever is in the un-tensioned position such that a ball striking the net at the lower open portion is trapped by the pocket.

9. The returning goal system of claim 1 wherein the first and second upper net supports are curved.

10. The returning goal system of claim 1 further comprising an arched net support disposed between the first and second upper net supports.

11. The returning goal system of claim 1 wherein the first and second lower net supports extend upwards at an angle $\pi$ of about 0° to about 90° relative to the axial length of the first and second lower support bars.

12. The returning goal system of claim 1 wherein the first and second lower net supports extend upwards at an angle $\pi$ of about 30° to about 60°.

13. The returning goal system of claim 1 further comprising at least one support disposed between the first and second sides of the goal for supporting the net at a desired height.

14. The returning goal system of claim 13 wherein the support may be repositioned along the first and second sides to vary the height at which the net is supported.

15. The returning goal system of claim 1 further comprising a plurality of holes disposed in a base of the goal and configured to receive a plurality of ground attachment devices for temporarily attaching the goal to a ground surface.

16. The returning goal system of claim 1 further comprising a rotational tensioning mechanism, wherein the net is connected to the upper back crossbar and wherein the upper back crossbar is freely rotatable within the first and second sides and may be locked into place using a locking mechanism selected from the group consisting of: a plurality of pins that may be inserted through a portion of the upper back crossbar and into a portion of the first and second sides, friction collar or ratcheting connection between the upper back crossbar and the first and second sides.

* * * * *